US008150301B2

(12) United States Patent
Adachi et al.

(10) Patent No.: US 8,150,301 B2
(45) Date of Patent: Apr. 3, 2012

(54) DEVELOPING APPARATUS

(75) Inventors: Motoki Adachi, Ashigarakami-gun (JP); Masahide Kinoshita, Mishima (JP); Hideo Kihara, Suntou-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 331 days.

(21) Appl. No.: 12/022,273

(22) Filed: Jan. 30, 2008

(65) Prior Publication Data

US 2008/0193171 A1 Aug. 14, 2008

(30) Foreign Application Priority Data

Feb. 8, 2007 (JP) ..... 2007-029719

(51) Int. Cl.
*G03G 15/08* (2006.01)

(52) U.S. Cl. ..... 399/281

(58) Field of Classification Search ..... 399/281, 399/284, 254, 256, 119, 262, 263
See application file for complete search history.

(56) References Cited

U.S. PATENT DOCUMENTS

| | | | | |
|---|---|---|---|---|
| 4,873,551 | A | 10/1989 | Tajima et al. | |
| 4,887,131 | A | 12/1989 | Kinoshita et al. | |
| 5,086,728 | A | 2/1992 | Kinoshita | |
| 5,311,264 | A | 5/1994 | Kinoshita | |
| 5,473,417 | A | 12/1995 | Hirano | |
| 5,893,013 | A | 4/1999 | Kinoshita et al. | |
| 6,141,519 | A * | 10/2000 | Sato | 399/252 |
| 6,347,208 | B1 * | 2/2002 | Yamamoto | 399/281 |
| 6,381,431 | B1 | 4/2002 | Kinoshita et al. | |
| 6,421,516 | B1 | 7/2002 | Kinoshita et al. | |
| 6,907,215 | B2 | 6/2005 | Yasukawa et al. | |
| 7,035,573 | B2 | 4/2006 | Yamaguchi et al. | |
| 7,356,281 | B2 * | 4/2008 | Miyakawa et al. | 399/111 |
| 2003/0128997 | A1 * | 7/2003 | Sakaizawa et al. | 399/55 |
| 2004/0057753 | A1 * | 3/2004 | Choi et al. | 399/228 |
| 2004/0096246 | A1 * | 5/2004 | Bae | 399/283 |

FOREIGN PATENT DOCUMENTS

| | | |
|---|---|---|
| JP | 6-194944 A | 7/1994 |
| JP | 8-62977 A | 3/1996 |

OTHER PUBLICATIONS

Chinese Office Action dated Nov. 27, 2009 in Chinese Application No. 2008-10004843.3, and an English-language translation therefor. Notification of the Third Office Action dated Oct. 27, 2010, in counterpart Chinese Application No. 200810004843.3.

* cited by examiner

*Primary Examiner* — Kiho Kim
(74) *Attorney, Agent, or Firm* — Fitzpatrick, Cella, Harper & Scinto

(57) ABSTRACT

A developing apparatus includes a developer carrying member for carrying a developer to develop an electrostatic image formed on an image bearing member with a developer, and a developer feeding member, for supplying the developer to the carrying member. The developing apparatus also includes a regulating member for regulating an amount of the developer carried on the carrying member, the regulating member having a free end portion contacted to the carrying member. The developer feeding member is supplied with a voltage which is different from a potential of the developer member toward a regular charging polarity of the developer. The carrying member is provided with a surface facing substantially downward, in a range from a downstream-most edge of the developer member in the contact portion with respect to a rotational direction of the carrying member to a contact portion between the carrying member and the regulating member.

9 Claims, 9 Drawing Sheets

DEVELOPING APPARATUS

FIELD OF THE INVENTION AND RELATED ART

The present invention relates to a developing apparatus, in particular, a developing apparatus which forms a visible image (image formed of toner) by developing an electrostatic image formed on an image bearing member with the use of an electrophotographic image forming method. A developing apparatus, such as the above described one, can be integrated as a part of an image forming apparatus, or a part of a process apparatus removably mountable in the main assembly of an image forming apparatus.

As examples of an image forming apparatus, an electrophotographic copying machine, an electrophotographic printer (laser beam printer, LED printer, etc.), a facsimile apparatus, a wordprocessor, a multifunction printer capable of performing two or more of the functions of the preceding image forming apparatuses, etc., may be included.

A process cartridge is a cartridge in which an electrophotographic photosensitive member, and at least one among a charging means, a developing means, and a cleaning means, for example, are integrally disposed so that they can be removably mountable in the main assembly of an image forming apparatus.

There have been known various methods used by a developing apparatus of an image forming apparatus, such as a copying machine, a printer, a facsimile apparatus, etc., which uses an electrophotographic process. One of these developing methods is the nonmagnetic single-component developing method.

FIG. 11 shows a developing apparatus 100, which uses the nonmagnetic single-component developing method. The developing apparatus 100 is of the contact type. It uses nonmagnetic single-component developer. The developing apparatus 100 in this embodiment has a housing 101, which has a toner storage chamber 110 and a development chamber 111. The toner storage chamber 110 stores toner T, which is nonmagnetic single-component toner. The development chamber 111 has a development roller 112, a toner supply roller 113, and a blade 114. The developer roller 112 is a developer bearing member, and is made up of a metallic shaft and a layer of electrically conductive rubber coated on the peripheral surface of the metallic shaft in a manner to wrap the development roller 112. The toner supply roller 113 is a member which supplies the development roller 112 with developer. It is made up of a metallic shaft, and a layer of sponge placed on the peripheral surface of the metallic shaft in a manner to wrap the metallic shaft. The blade 114 is a regulating member. It is made up of a piece of metallic plate. Designated by a referential numeral 116 is a photosensitive drum, which is an image bearing member. It is rotated in the direction indicated by an arrow mark A. The development roller 112 is positioned in parallel to the photosensitive drum 116 so that its peripheral surface is placed in contact, or virtually in contact, with the peripheral surface of the photosensitive drum 116, forming thereby a developing portion G.

The toner in the toner storage 110 is conveyed into the development chamber 111 by a toner conveying member 115, which is made up of a flexible blade (blades). The toner T in the development chamber 111 is supplied to the development roller 112 by the toner supply roller 113, which coats the peripheral surface of the development roller 112 with toner, forming a layer of toner on the peripheral surface of the development roller 112. Then, the layer of toner on the peripheral surface of the development roller 112 is regulated by the regulating blade 114 in thickness so that the amount of the toner, per unit area of the peripheral surface of the development roller 112, becomes proper. As the toner is coated on the peripheral surface of the development roller 112 by the toner supply roller 113, the toner particles are given a proper amount of electrical charge by friction.

The layer of toner on the development roller 112 is moved by the rotation of the development roller 112 through the regulating portion H, in which the regulating blade 14 is in contact with the peripheral surface of the development roller 112. Thereafter, the layer of toner is conveyed to the developing portion G, that is, the area in which the peripheral surface of the development roller 112 is in contact (virtually in contact) with the peripheral surface of the photosensitive drum 116. In the developing portion G, the toner particles in the layer of toner adhere to the electrostatic latent image on the peripheral surface of the photosensitive drum 116, which has been formed through the charging and exposing processes. As a result, the latent image turns into a visible image.

The toner particles (development residual toner particles) remaining on the peripheral surface of the development roller 112, that is, the toner particles on the peripheral surface of the development roller 112, which did not adhere to the peripheral surface of the photosensitive drum 116, are recovered by the toner supply roller 113. In order to ensure that the development residual toner particles on the development roller 112 are efficiently recovered, the toner supply roller 113 is rotated in such a direction that in the area of contact F between the development roller 112 and toner supply roller 113, the peripheral surface of the toner supply roller 113 moves in the opposite (counter) direction from the moving direction of the development roller 112. That is, referring to FIG. 11, the development roller 112 rotates in the clockwise direction indicated by an arrow mark C, and the toner supply roller 113 rotates in the same direction as the development roller 112 (clockwise direction indicated by arrow mark D). Thus, the peripheral surface of the development roller 112 and the peripheral surface of the toner supply rollers 113 intensely rub against each other in the area F of contact, making it possible to recover the development residual toner particles.

It has been known to apply to the toner supply roller 13, such voltage (toner supply bias) that is the same in polarity as toner, and is greater in absolute value than that applied to the development roller 112, as disclosed in Japanese Laid-open Patent Application H06-194944. The application of such voltage is effective to reliably supply the development roller 12 with toner. Therefore, it is effective to prevent the formation of defective images, more specifically, images which are abnormally low in density, and/or faint, which is attributable to the problem that the development roller 12 is unsatisfactorily supplied with toner, even when a substantial number of high density images have to be continuously formed.

Further, providing a difference in potential level between the development roller 112 and toner supply roller 113, by applying toner supply bias as described above, makes it possible to supply the development roller 112 with only the toner particles which are normal in polarity. Therefore, it stabilizes the developing apparatus in the amount of the electrical charge of the toner on the development roller 112, and therefore, prevents the formation of defective images, for example, images which are abnormal in density, images suffering from fog, and the like.

However, the structural arrangement for the developing apparatus 100 shown FIG. 11 is unsatisfactory for the purpose of achieving a substantially higher level of image quality than that achievable by the structural arrangement for a developing apparatus in accordance with the prior art, in particular, regarding fog.

In the case of the structural arrangement for the developing apparatus 100 shown in FIG. 11, the upstream edge (toner spewing portion Fa) of the area of contact F between the development roller 112 and toner supply roller 113, in terms of the rotational direction of the development roller 112 is the top edge of the area of contact F. Therefore, the toner particles spewed out of the toner spewing portion Fa hang over the toner spewing portion Fa. That is, the toner particles which were not supplied to the development roller 112 become stagnant in the adjacencies of the toner spewing portion Fa. In other words, the toner particles, which are hanging over the toner spewing portion Fa are those which were not supplied to the development roller 112 even though toner supply bias was applied. Therefore, these toner particles are not normal in polarity (reversal in polarity), and/or smaller in the amount of electrical charge (weakly charged toner particles) than the toner particles which were coated on the development roller 112.

With these toner particles being present in the adjacencies of the development roller 112, in particular, hanging over the development roller 112, they are gradually conveyed into the regulating portion H by the rotation of the development roller 112. Thus, the development roller 112 is supplied with these toner particles, in addition to the toner particles supplied by the toner supply roller 113. Therefore, the developing apparatus 100 sometimes becomes unstable in the amount of the electrical charge of the toner on the development roller 112, in spite of the desire to keep the developing apparatus 100 stable in terms of the abovementioned aspect. In other words, the effect of the application of the toner supply bias is prevented from becoming manifest.

Further, the regulating blade 114 is a piece of SUS plate, one of the end portions of which is bent in the shape of a letter L. The amount by which toner was allowed to remain coated, per unit area of the peripheral surface of the development roller 112, before the layer of toner on the development roller 112 is moved into the developing portion G, is regulated by placing the bend of the regulating blade 114 in contact with the peripheral surface of the development roller 112. This regulating method has been widely known.

Structuring the developing apparatus 100 as described above, that is, structuring the developing apparatus 100 so that the bend of the regulating blade 114 is placed in contact with the peripheral surface of the development roller 112, causes the portion (NE) of the regulating blade 114, which is between the edge 114*a* of the blade 114 and the area of contact H, to extend from the area of contact H into the development chamber 111, creating thereby the following problems:

That is, the portion NE of the regulating blade 114, that is, the portion of the regulating blade 114, which extends into the development chamber 111, acts as a guide which aggressively guides the toner particles which are in the area between the portion NE and development roller 112, into the area of contact H. Therefore, even if toner supply bias is applied to the toner supply roller 113 to supply the development roller 112 with only the toner particles which are normal in polarity, the toner particles which are not normal in polarity are also guided into the area of contact H, along with the toner particles which are normal in polarity. Thus, the developing apparatus 100 sometimes becomes unstable in the amount of the electrical charge of the toner on the development roller 112, on the downstream side of the area of contact H, in terms of the rotational direction of the development roller 112.

SUMMARY OF THE INVENTION

The primary object of the present invention is to provide a developing apparatus which supplies its developer bearing member with only the developer particles which are normal in polarity, being therefore stable in the amount of the electrical charge of the developer on the developer bearing member.

Another object of the present invention is to provide a developing apparatus which does not cause an image forming apparatus to form an image suffering from defects, such as fog, attributable to the instability in the amount of the electrical charge of the developer on the development roller, and therefore, enables the image forming apparatus to reliably form satisfactory images for a long period of time.

Another object of the present invention is to provide a developing apparatus in which developer is reliably supplied to its developer bearing member by its developer supplying member.

Another object of the present invention is to provide a developing apparatus which does not cause an image forming apparatus to form an image which is abnormally low in density, being therefore faint, even when a substantial number of high density images are continuously formed.

These and other objects, features, and advantages of the present invention will become more apparent upon consideration of the following description of the preferred embodiments of the present invention, taken in conjunction with the accompanying drawings.

DETAILED DESCRIPTION OF THE PREFERRED EMBODIMENTS

Hereinafter, the developing apparatuses in accordance with the present invention will be described in more detail with reference to the appended drawings.

Embodiment 1

Figure 1:
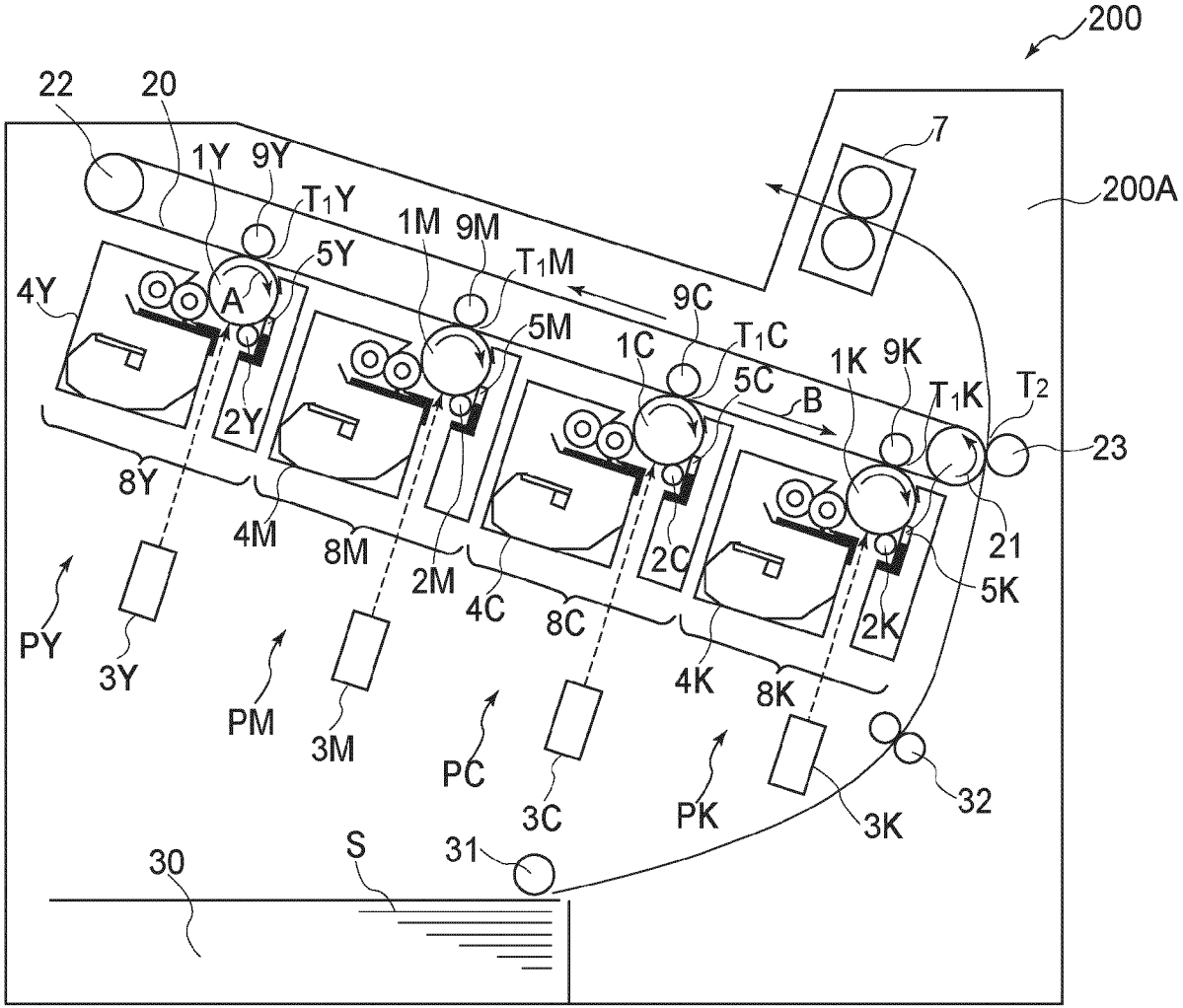
FIG. 1 is a schematic sectional view of the image forming apparatus in the first embodiment of the present invention, showing the general structure of the apparatus.

FIG. 1 is a schematic sectional view of the image forming apparatus in the first embodiment of the present invention, and shows the general structure of the apparatus. The image forming apparatus 200 in this embodiment is a color laser printer of the transfer type, which employs one of the known electrophotographic processes. It also employs a charging system of the contact type, and a development system which uses single-component developer. The image forming apparatus 200, that is, the printer in this embodiment, is capable of forming and outputting a full-color image on a sheet of recording medium S, such as a sheet of paper, OHP sheet, etc., in accordance with pictorial information it receives from an external host apparatus (unshown) connected thereto so that information can be exchanged between it and host apparatus.

The image forming apparatus 200 in this embodiment, which is capable of outputting a full-color image, employs four drums, which are juxtaposed in parallel, being therefore sometimes referred to as an image forming apparatus of the in-line type. More concretely, the image forming apparatus 200 has multiple image forming means, that is, four image forming portions P (Pa, Pb, Pc, and Pd) which form yellow (Y), magenta (M), cyan (C), and black (K) images, respectively. The images formed by the image forming portions P are temporarily transferred in layers onto an intermediary transfer belt 20 (intermediary transfer member), and then, are transferred together onto a sheet of recording medium S, for example, a sheet of paper. The intermediary transfer belt 20 is supported, being thereby stretched, by a driver roller 21 and a support roller 22, and is driven in the direction indicated by an arrow mark B.

The image forming portions P (Pa, Pb, Pc, and Pd) are the same in structure. Each image forming portion P has an image bearing member, which is an electrophotographic photosensitive member 1 (1Y, 1M, 1C, and 1K), which is in the form of a drum (which hereafter may be referred to as photosensitive drum); the image forming apparatuses Pa, Pb, Pc, and Pd have photosensitive drums 1Y, 1M, 1C, and 1K, respectively. Each image forming portion P has a charge roller 2 (2Y, 2M, 2C, and 2K) as a charging means, and a laser beam scanning apparatus 3 (3Y, 3M, 3C, and 3K) as an exposing means, which is in the adjacencies of the peripheral surface of the photosensitive drum 1. The charge roller 2 and exposing apparatus 3 form an electrostatic latent image on the photosensitive drum 1. Also disposed in the adjacencies of the peripheral surface of the photosensitive drum 1 are a developing apparatus 4 (4Y, 4M, 4C, and 4K) as a developing means, and a cleaning apparatus 5 (5Y, 5M, 5C, and 5K) as a cleaning means for removing the toner remaining on the photosensitive drum 1. The developing apparatus 4 develops the electrostatic latent image on the photosensitive drum 1, into a visible image (image formed of toner, which hereafter will be referred to as toner image).

In this embodiment, the abovementioned photosensitive drum 1, charge roller 2, developing apparatus 4, and cleaning apparatus 5, which make up the image forming portion P, are integrally placed in a cartridge, making up a process cartridge 8 (8*a*, 8*b*, 8*c*, and 8*d*), which is replaceably mountable in the main assembly 200A of the image forming apparatus 200 through a process cartridge mounting-and-removing means (unshown). Thus, if the developing apparatus 4 of the process cartridge 8 in the main assembly 200A reaches the end of its service life, for example, runs out of toner, the process cartridge 8 can be replaced with another process cartridge 8 (for example, a brand-new process cartridge).

The image forming apparatus 200 employs four process cartridges 8, that is, process cartridge 8Y (which uses yellow toner), 8M (which uses magenta toner), 8C (which uses cyan toner), and 8K (which uses black toner), which are juxtaposed in parallel, in the direction parallel to the circulatory direction of the intermediary transfer belt 20.

The image forming sequence of the image forming apparatus 200 is as follows: First, the peripheral surface of the photosensitive drum 1 is uniformly charged by the charge roller 2, in the image forming portion P. Then, a latent image, which reflects the pictorial signals inputted from a controller, is formed on the uniformly charged portion of the peripheral surface of the photosensitive drum 1 by the exposing apparatus 3. This latent image is developed into a toner image by the developing apparatus 4. This image forming sequence is carried out in each image forming portion P.

The four monochromatic toner images, different in color, are transferred (primary transfer) onto the intermediary transfer belt 20 by transfer rollers 9 (9Y, 9M, 9C, and 9K) as transferring means, in the primary transferring portions T1 (T1*a*, T1*b*, T1*c*, and T1*d*), effecting thereby a single full-color image on the intermediary transfer belt 20. Then, the four monochromatic toner images, which effected a single full-color image, are transferred together onto the recording medium S, in the second transferring portion T2 where a transfer roller 23, which is a secondary transferring means, is disposed. Regarding the recording medium S, multiple sheets of recording mediums S are stored in a sheet feeder cassette 30. As an image forming operation begins, the multiple sheets of recording medium S are sent one by one from the sheet feeder cassette 30 by a recording medium conveyance roller 32, which is a recording medium conveying means, to the secondary transferring portion T2 in which the transfer roller 23 is located.

After the transfer of the full-color toner image onto the recording medium S, the recording medium S is conveyed to a fixing apparatus 7, in which the toners images (full-color image) are fixed to the recording medium S. Then, the recording medium S is discharged from the image forming apparatus. Meanwhile, the transfer residual toner particles, that is, the toner particles remaining on the peripheral surface of the toner image transfer, is removed by the cleaning apparatus 5 (5*a*, 5*b*, 5*c*, and 5*d*).

Figure 2:
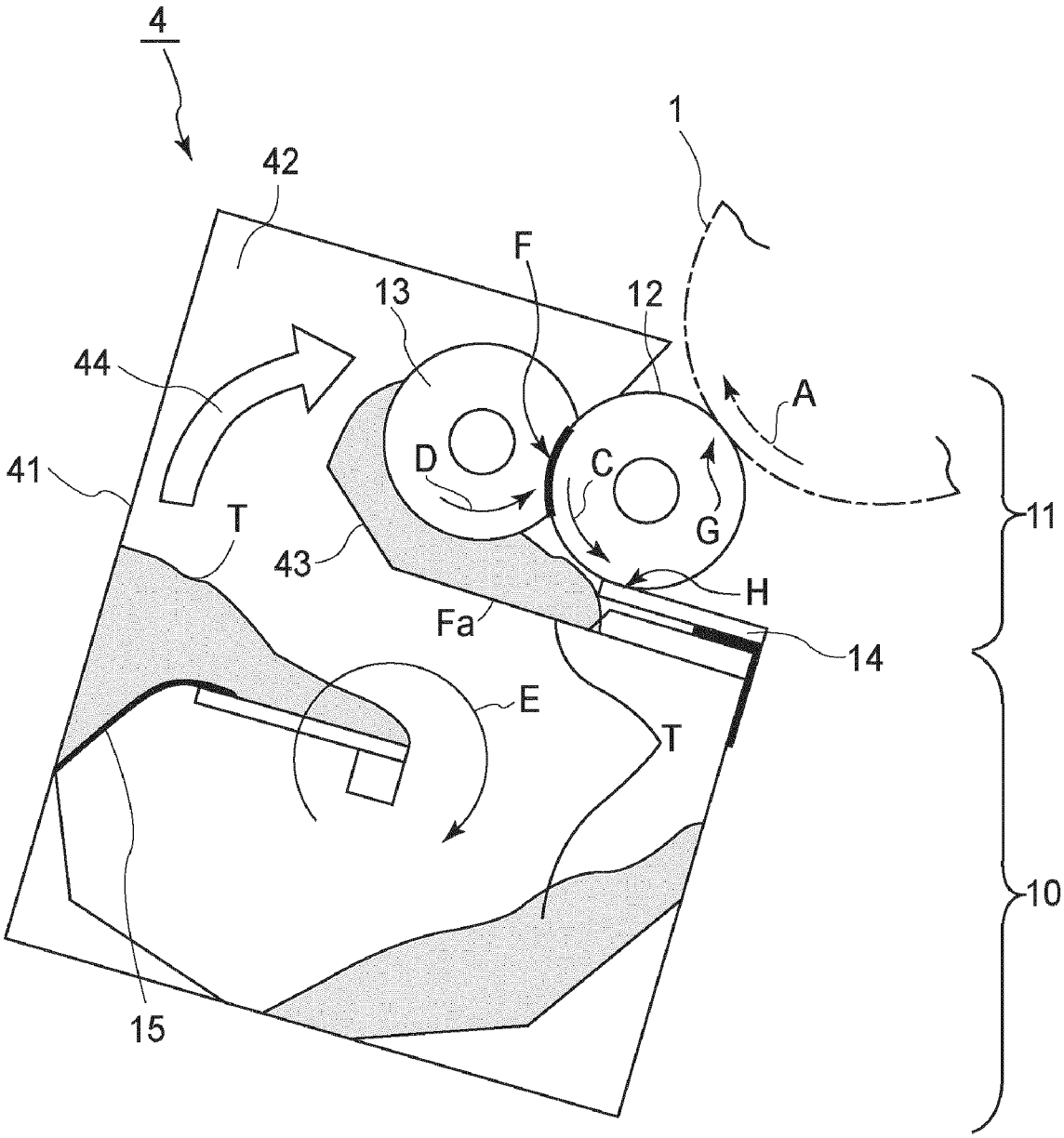
FIG. 2 is a schematic sectional view of the developing apparatus in the first embodiment of the present invention, showing the general structure of the apparatus.

Next, referring to FIG. 2, the general structure of the developing apparatus 4 in this embodiment will be described. The developing method employed by the developing apparatus 4 is of the contact type. It uses nonmagnetic single-component developer.

The developing apparatus 4 in this embodiment has a housing 41, which has a toner storage chamber 10 and a development chamber 11.

The toner storage chamber 10 stores toner T. It has a toner conveying member 15, which is a flexible blade. The toner conveying member 15 is rotated in the direction indicated by an arrow mark in FIG. 2, conveying thereby the toner in the toner storage chamber 10 to the development chamber 11 while stirring the toner.

There are a development roller 12, a toner supply roller 13, and a regulating blade 14, in the development chamber 11. The development roller 12 is a developer bearing member, and is rotated in the direction indicated by an arrow mark C. The toner supply roller 13 is a member which coats the development roller 12 with developer. It is rotated in the direction indicated by an arrow mark D. The regulating blade 14 is a member which regulates the amount by which developer is allowed to remain coated on the peripheral surface of the photosensitive drum 1, per unit area, after the developer is coated on the peripheral surface of the photosensitive drum 1.

The development chamber 11 in this embodiment is located on top of the toner storage chamber 10. There is an opening 42 between the development chamber 11 and toner storage chamber 10, allowing the toner in the housing 41 to move between the toner storage chamber 10 and development chamber 11. As the toner conveying member 15 is rotated, the toner T in the toner storage chamber 10 is conveyed, as if being flipped up, into the development chamber 11 through the opening 42, as indicated by an arrow mark 44.

The development chamber 11 is provided with a toner storage 43, which stores the toner conveyed from the toner storage chamber 10. The developing apparatus 4 is structured so that the toner supply roller 13 is partially or fully enclosed in the toner storage 43. The toner supply roller 13 is placed in contact with the development roller 12. It is rotated in such a direction that in the area of contact F (coating portion) between the toner supply roller 13 and development roller 12, the peripheral surface of the toner supply roller 13 moves in the direction opposite (counter) to that in which the peripheral surface of the development roller 12 moves. That is, in the area of contact F, the peripheral surface of the development roller 12 moves downward (direction of gravity), whereas the peripheral surface of the toner supply roller 13 moves upward (direction opposite to direction of gravity). In other words, in terms of the rotational direction of the toner supply roller 13, the downstream edge of the area of contact F is roughly straight above the upstream edge of the area of contact F.

The toner in the toner storage 43 is conveyed to the area of contact F between the toner supply roller 13 and development roller 12 by the rotation of the toner supply roller 13, to be coated on (supplied to) the development roller 12. When the toner is coated on the peripheral surface of the development roller 12 by the toner supply roller 13, the toner is charged by the friction between the toner and development roller 12. The toner supply roller 13 also scrapes away, in the area of contact F, the toner remaining on the peripheral surface of the development roller 12 after the development of a latent image.

It is in the development chamber 11 that the blade 14 is disposed as a regulating member, being kept pressed against the peripheral surface of the development roller 12. After the toner T is coated on the peripheral surface of the development roller 12, the layer of toner T on the development roller 12 is regulated in thickness, while being given electrical charge, by the blade 14. As a result, a thin layer of toner T is formed on the peripheral surface of the development roller 12.

The development roller 12 is positioned so that its peripheral surface is kept pressed against the peripheral surface of the photosensitive drum 1, forming thereby a developing portion G, in which the contact pressure between the development roller 12 and photosensitive drum 1 has a preset value. The development roller 12 is rotated so that in the area of contact G, its peripheral surface moves in the same direction as the moving direction of the peripheral surface of the photosensitive drum 1, with the presence of a preset amount of difference between its peripheral velocity and that of the photosensitive drum 1.

The thin toner layer formed on the peripheral surface of the development roller 12 by the blade 14 is conveyed by the rotation of the development roller 12 to the area of contact G between the development roller 12 and photosensitive drum 1, in which the latent image on the peripheral surface of the photosensitive drum 1 is developed. The toner particles remaining on the peripheral surface of the development roller 12, that is, the toner particles which were not used for the development of the latent image are removed from the peripheral surface of the development roller 12 by the aforementioned toner supply roller 13.

As the development roller 12 and toner supply roller 13 rotate in the abovementioned directions, respectively, pressure is generated on the upstream side of the area of contact G, in terms of the rotational direction of the toner supply roller 13. Thus, this force pushes the toner T in the toner storage 43, into to the opening 42, along with air, and falls back into the toner storage chamber 10. Thus, the toner T in the toner storage 43 does not stagnate in the toner storage 43. That is, the body of toner T in the toner storage 43 is continuously replaced by the next body of toner, which is conveyed into the toner storage 43 from the toner storage chamber 10; toner is circulated through the toner storage 43.

The development roller 12 employed by the developing apparatus 4 in this embodiment is a semiconductive elastic roller. It is provided with an elastic layer, and is 16 mm in external diameter. The material for the semiconductive elastic layer is a soft rubber or a foamed substance, such as silicone rubber, urethane, etc., in which electrically conductive substance, such as carbon, has been dispersed, and the volume resistivity of which is in a range of $10^2$ ohm.cm-$10^{10}$ ohm.cm. In some cases, it is formed of a combination of the abovementioned substances.

The toner supply roller 13 is an elastic roller, which is 16 mm in external diameter. Its elastic surface layer is formed of electrically conductive foamed substance (conductive sponge). It is kept pressed against the development roller 12 so that the amount of its apparent intrusion into the development roller 12, in the area of contact F, is 1.5 mm.

The blade 14 is a piece of plate spring formed of SUS. It is kept in contact with the peripheral surface of the development roller 12, being elastically bent in curvature, so that a preset amount of contact pressure is maintained between the blade 14 and development roller 12, in the area of contact H.

In this embodiment, −350 V and −550 V are applied to the development roller 12 and toner supply roller 13, respectively. To the blade 14, −550 V is applied. Incidentally, the potential level to which the photosensitive drum 1 is charged by the charging apparatus 2 is −550 V.

The developer used by the developing apparatus 4 in this embodiment is nonmagnetic single-component toner, which is negatively chargeable.

The process speed of the image forming apparatus in this embodiment, that is, the peripheral velocity of the photosensitive drum 1, is 150 mm/sec, whereas the peripheral velocity of the development roller 12 is 180 mm/sec.

At this point in time, what characterizes this embodiment, more specifically, the method for supplying the development roller 12 with only the normally charged toner particles, and the structural arrangement for carrying out this method, will be described.

First, the voltage to be applied to the toner supply roller 13 will be described.

In this embodiment, the voltage (toner supply bias) applied to the toner supply roller 13 is greater in absolute value than the voltage applied to the development roller 12. The voltage applied to the development roller 12 is the same in polarity as the polarity to which toner is charged. More specifically, to the development roller 12, −350 V is applied, and to the toner supply roller 13, −550 V is applied.

That is, to the toner supply roller 13, such voltage that is the same in polarity as the developer (toner), and provides a difference in voltage (−200 V) between the toner supply roller 13 and development roller 12, is applied. In other words, the voltage applied to the toner supply roller 13 is set so that its polarity is the same as the normal polarity to which the developer is chargeable, being therefore the same as the voltage applied to the development roller 12, and also, that its absolute value is greater than that of the voltage applied to the development roller 12.

Figure 3:
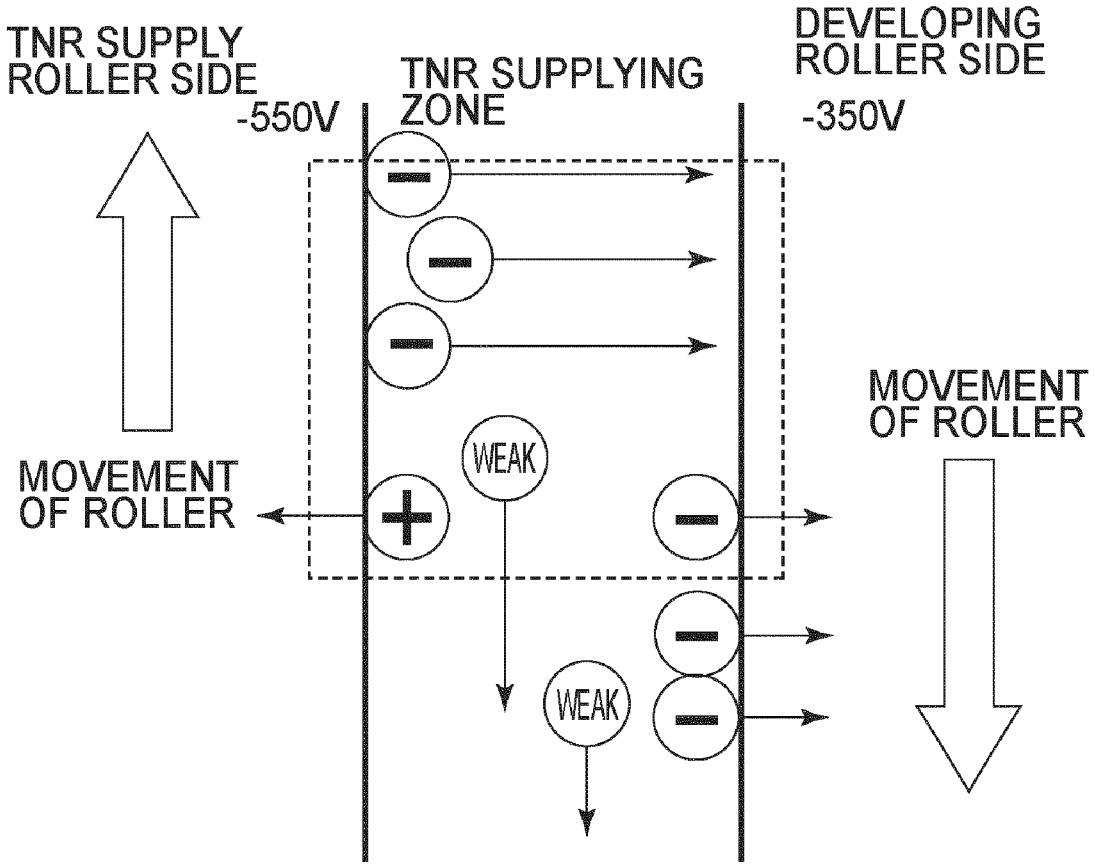
FIG. 3 is a schematic drawing which shows the toner movement in the toner supplying portion.

Referring to FIG. 3, therefore, it is possible to coat the development roller 12 with only the normally (negatively) charged toner particles. That is, it is possible to prevent the positively charge toner particles, and the toner particles, which are normal (negative) in polarity, but, are insufficient in the amount of electrical charge, from adhering to the development roller 12.

Next, the positioning of the development roller 12, toner supply roller 13, and blade 14, will be described.

By applying toner supply bias as described above, it can be ensured that the development roller 12 is supplied with only the normally charged toner.

Figure 4:
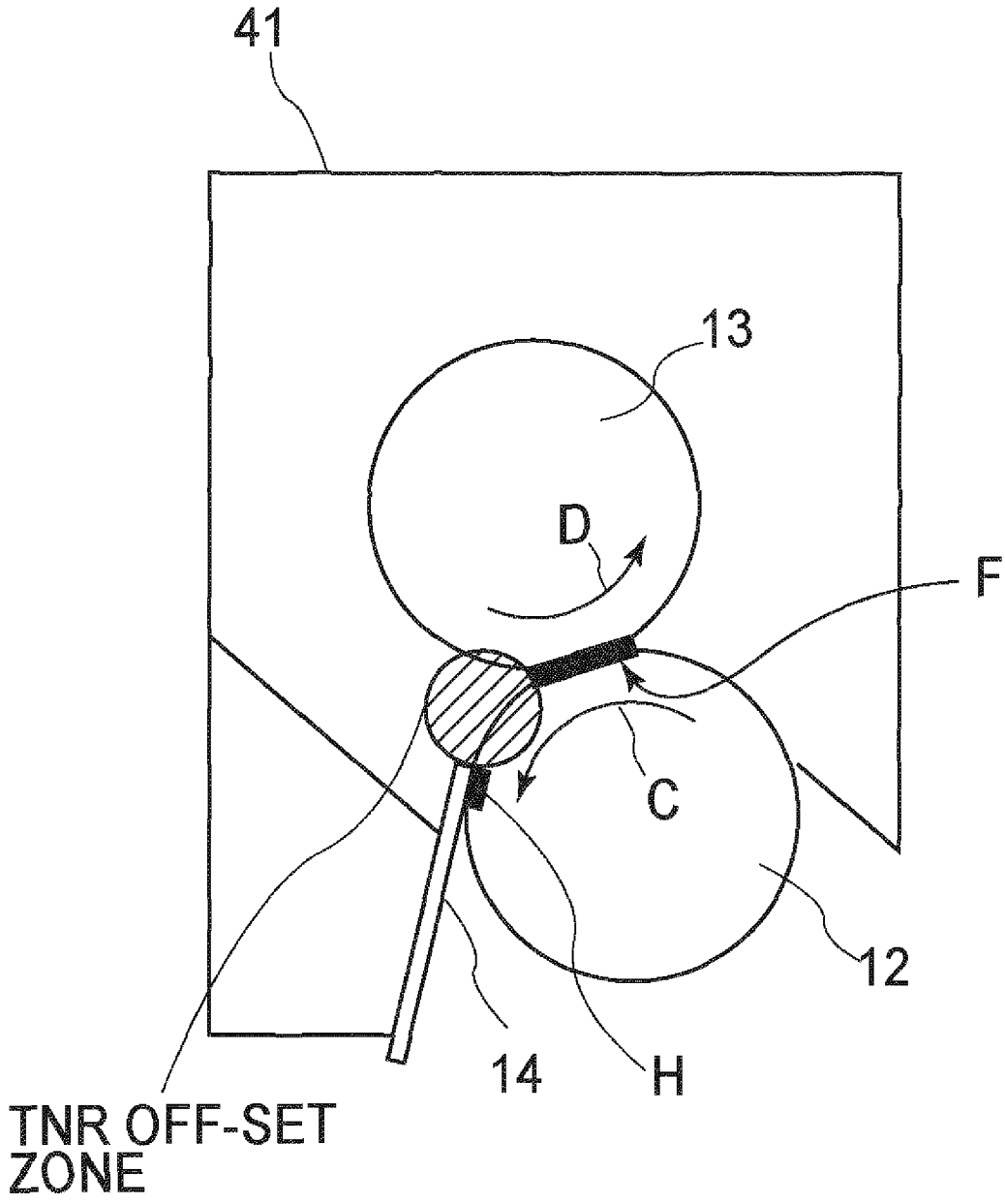
FIG. 4 is a schematic sectional view of a developing apparatus in accordance with the prior art, showing the positioning of the developer roller, toner supply roller, and blade in the development chamber, which results in the toner accumulation on the development roller.

However, in a case where the developing apparatus 4 is structured so that the toner supply roller 13 is positioned on top of the development roller 12, as shown in FIG. 4, for example, the following problem occurs:

That is, it is possible that while the portion of the peripheral surface of the development roller 12, which is in the area of contact F (coating area) between the development roller 12 and toner supply roller 13, is moved from the area of contact F to the area of contact H (regulating portion) between the development roller 12 and regulation blade 14, the toner particles in the body of toner T in the adjacencies of the development roller 12 will settle on (and adhere to) the toner layer on the peripheral surface of the development roller 12, and be conveyed to the regulating portion H. In other words, it is possible that the toner particles, which have not been properly charged, will be conveyed to the regulating portion H, and coated on the peripheral surface of the development roller 12.

Figure 5:
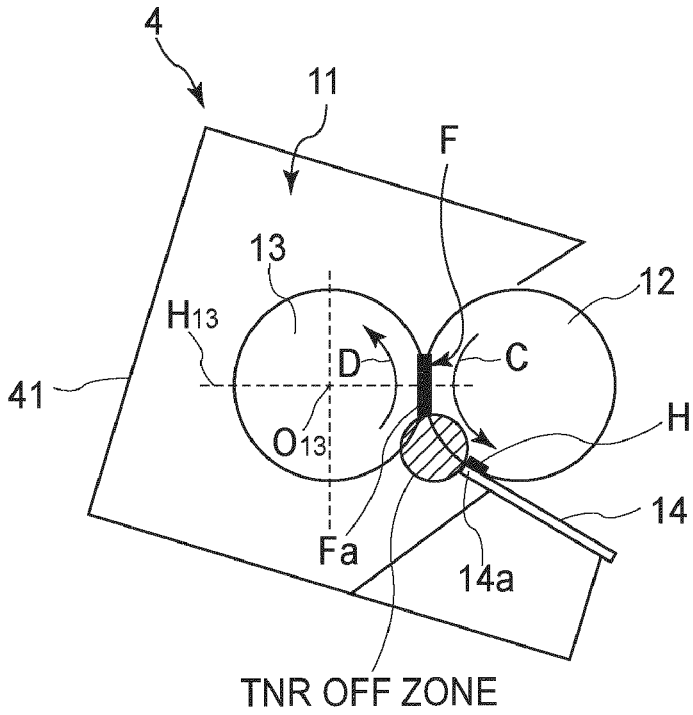
FIG. 5 is a schematic sectional view of the developing in the first embodiment of the present invention, showing the positioning of the developer roller, toner supply roller, and blade in the development chamber of the developing apparatus.

Thus, in the case of the developing apparatus 4 in this embodiment, its development roller 12, toner supply roller 13, and blade 14 are positioned so that as a given portion of the peripheral surface of the development roller 12 moves into the area between the coating portion F, that is, the area of contact between the development roller 12 and toner supply roller 13, and the regulating portion H, that is, the area of contact between the development roller 12 and blade 14, it becomes roughly parallel to the direction of gravity (vertical direction), as shown in FIG. 5. That is, the development roller 12 and toner supply roller 13 are positioned so that while a given portion of the peripheral surface of the development roller 12 is moving through the area between the coating portion F and regulating portion H, it remains roughly vertical. In other words, while a give portion of the peripheral surface of the development roller 12 is in the area between the coating portion F and regulating portion H, it remains below the horizontal plane which coincides with the rotational axis of the toner supply roller 13.

With the provision of this structural arrangement, should toner particles which are insufficient in the amount of charge, and/or toner particles which are reverse in polarity, adhere to the peripheral surface of the development roller 12, they would be peeled away from the peripheral surface of the development roller 12 by their own weight, because there is no electrostatic attraction between them and the peripheral surface of the development roller 12. Therefore, not only is the development roller 12 not supplied with an excessive amount of toner by the toner supply roller 13, but also, only the toner particles supplied by the toner supply roller 13, that is, the toner particles which are normal in polarity and amount of electrical charge, remain on the peripheral surface of the development roller 12.

Lastly, the regulating blade 14 will be described.

The toner particles spewed out of the toner storage 43 by the pressure generated in the adjacencies of the coating portion F by the toner supply roller 13, and/or toner particles which fell from the development roller 12, are carried to the adjacencies of the blade 14 by the air movement (wind) or the like caused by the rotation of the development roller 12, or the like.

Figure 6:
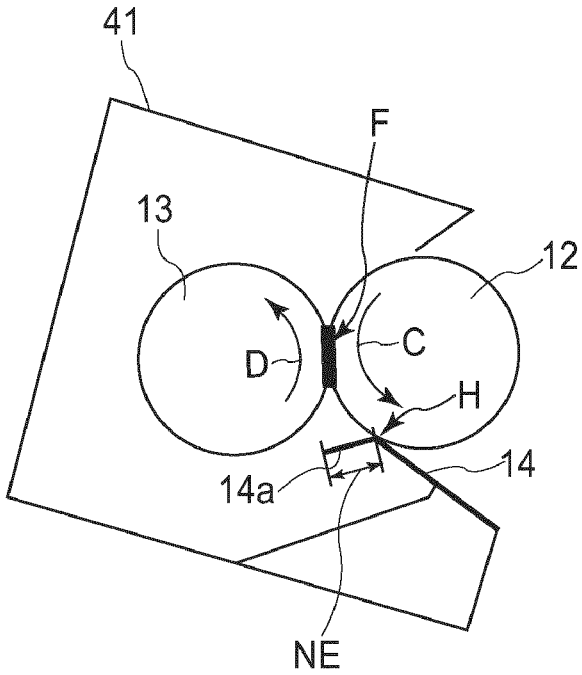
FIG. 6 is a schematic sectional view of a developing apparatus structured so that its regulating portion has the NE portion.

Referring to FIG. 6, if the developing apparatus 4 is structured so that the edge 14*a* of the regulating blade 14 extends beyond the area of contact H (regulating portion) between the development roller 12 and blade 14 (that is, if developing apparatus 4 is structured so that portion NE is created), the portion NE of the blade 14 functions a toner guide, making it possible for the toner in the adjacencies of the blade 14 to be conveyed to the regulating portion H and coated on the peripheral surface of the development roller 12. The NE portion is the portion of the blade 14, which is extending beyond the area of contact between the blade 14 and development roller 12.

In order to prevent the toner in the adjacencies of the blade 14 from being guided to the regulating portion H by the NE portion, the developing apparatus 4 in this embodiment is structured so that only the edge 14*a* of the regulating blade 14 contacts the development roller 12 (that is, contact only by edge) to regulate the toner layer on the peripheral surface of the development roller 12 in terms of the amount per unit area. With the employment of this structural arrangement, the toner particles floating in the adjacencies of the blade 14 are not guided into the regulating portion H. Therefore, only the toner particles coated on the development roller 12 by the toner supply roller 13 are moved into the regulating portion H. In other words, only the toner particles which have just been satisfactorily charged to the normal polarity enter the regulating portion H, and are coated on the peripheral surface of the development roller 12.

To summarize, the developing apparatus 4 in this embodiment is structured so that the toner supply bias is applied to the toner supply roller 13; the toner supply roller 13 and development roller 12 are positioned so that while a given portion of the peripheral surface of the development roller 12 is moved between the coating portion F and regulating portion H by the rotation of the development roller 12, it faces downward (in the direction parallel to direction of gravity); and the regulating blade 14 contacts the peripheral surface of the development roller 12 only by its edge 14*a*. Therefore, it is possible to ensure that the development roller 12 is supplied with only the toner particles which are normal in polarity and amount of electrical charge.

Regarding the positioning of the toner supply roller 13 relative to the development roller 12, the toner supply roller 13 is desired to be positioned as shown in FIG. 5. That is, the toner supply roller 13 is desired to be positioned so that the downstream edge Fa of the area of contact F (coating portion) between the toner supply roller 13 and development roller 12, in terms of the rotational direction of the development roller 12, coincides with, or is below, the horizontal plane H13 which includes the rotational axis O13 of the toner supply roller 13.

With the toner supply roller 13 and development roller 12 positioned as described above, even if a certain mount of toner is spewed into the air by the pressure generated by the rotation of the toner supply roller 13, in the coating portion F, the spewed toner does not settle on the toner supply roller 13.

Figure 7:
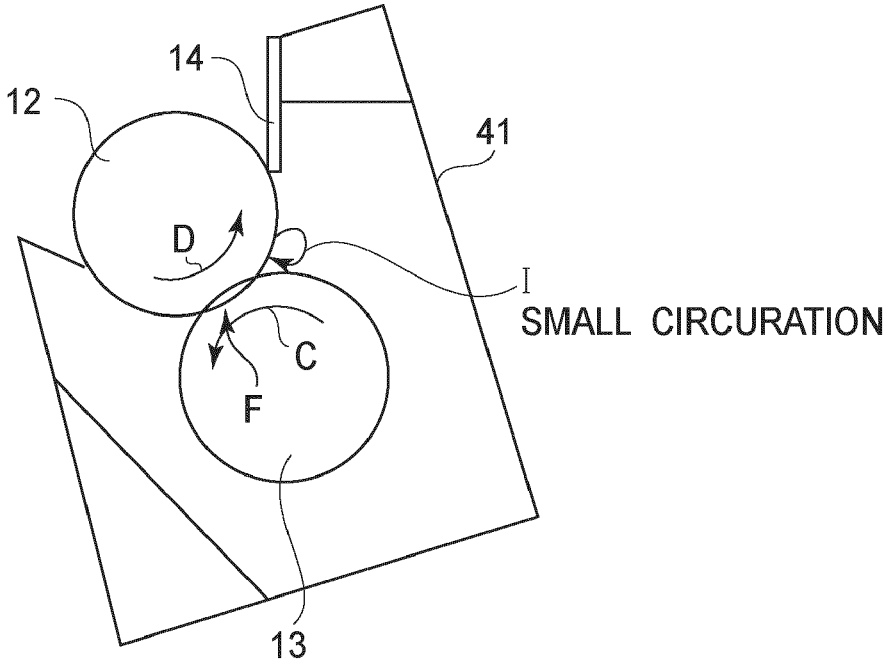
FIG. 7 is a schematic sectional view of a developing apparatus in which toner re-circulates in the small area in the adjacencies of the area from which toner is spewed, showing the positioning of the development roller, toner supply roller, and blade of the developing apparatus.

In a case where the developing apparatus 4 is structured so that the toner supply roller 13 is positioned diagonally below the development roller 12, for example, as shown in FIG. 7, the same body of toner is repeatedly sent back to the coating portion F; in other words, once a body of toner is moved into an area I, it is continuously recirculated in the area I, and therefore, prematurely deteriorates, creating thereby problems, such as the formation of a foggy image, fusion of toner to the blade 14, etc.

In this embodiment, however, the developing apparatus 4 is structured as described above (as shown in FIG. 5). Therefore, the toner does not continuously recirculate in the area I, and therefore, does not prematurely deteriorate. In other words, the developing apparatus 4 in this embodiment can make developer last longer than a developing apparatus in accordance with the prior art.

The inventors of the present invention comparatively studied the structure of the developing apparatus 4 in this embodiment, and the structure of a conventional developing apparatus, that is, a developing apparatus in accordance with the prior art.

The developing apparatus 4 in this embodiment and a conventional developing apparatus were compared in terms of the amount (Q/M) of electrical charge, per unit amount of toner on the peripheral surface of the development roller 12, on the downstream side of the regulating portion H, and the amount of fog of an image.

<Method for Measuring Amount of Electrical Charge of Toner>

Figure 8:
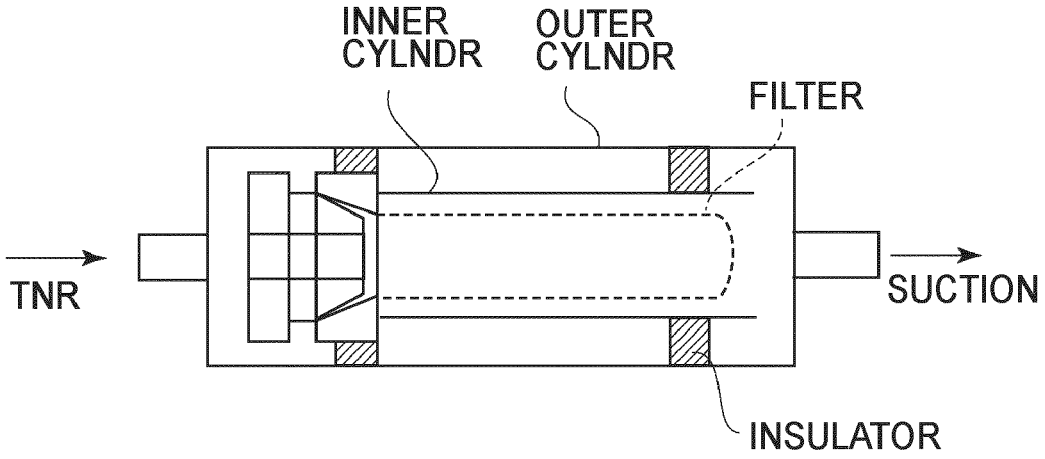
FIG. 8 is a schematic drawing of an apparatus used for measuring the amount of charge which the toner on the development roller has.

The amount of electrical charge of the toner on the peripheral surface of the development roller 12 is measured with the use of the following method:

That is, it is measured with the use of a Faraday cage shown in FIG. 8. The Faraday cage is a double-walled cylindrical container made up of two concentric cylindrical walls, that is, an internal cylindrical wall, and an external cylindrical wall, which are insulated from each other. Placing a substance, which is an amount Q of electrical charge, in the internal cylinder creates the same effects as the presence of a metallic cylinder, which is Q in the amount of electrical charge, because of electrostatic induction. The amount of this induced electrical charge is measured by a Keithley 616 Digital Electrometer. Then, the obtained amount (Q) of the Faraday cage is divided by the value of the weight M of the body of toner in the internal cylinder, obtaining thereby the value of (μC/g). The value is used as the amount of electrical charge of the toner on the aforementioned portion of the peripheral surface of the development roller 12. The toner on the peripheral surface of the development roller 12 is directly caught by a filter by suction.

<Method for Measuring Amount of Fog>

The amount of fog was obtained with the use of a Reflection Densitometer TC-6DS (product of Tokyo Denshoku Co., Ltd.). More specifically, it is obtained by subtracting the reflection density (%) of a solid white image formed on a sheet of recording paper, from the reflection density (%) of a plane sheet of recording paper which belongs to the same lot as the sheet of recording paper on which the solid white image was formed.

Next, the comparative developing apparatuses will be described regarding their structure.

<Comparative Developing Apparatus 1>

The first comparative developing apparatus was the same in structure as the developing apparatus 4 in this embodiment. The first comparative developing apparatus is different from the developing apparatus 4 in this embodiment in that in the case of the first comparative developing apparatus, the toner supply bias, which characterizes the first embodiment of the present invention, is not applied to the toner supply roller 13, and therefore, the toner supply roller 13 and development roller 12 are the same in potential level.

<Comparative Developing Apparatus 2>

The second comparative developing apparatus is different in structure from the developing apparatus 4 in this embodiment. That is, referring to FIG. 9, the second comparative developing apparatus is structured so that the toner spewing portion F of the coating portion F faces upward. That the toner spewing portion F faces upward means that in the coating portion F, the peripheral surface of the toner supply roller 13 moves downward. This structural arrangement does not meet concur with one of the features of the developing apparatus 4 in this embodiment, which characterizes the present invention, that is, "while a given portion of the peripheral surface of the development roller 12 moves between the coating portion F and regulating portion G, it remains facing downward". While a given portion of the peripheral surface of the development roller 12 is facing downward, it is below the horizontal plane which coincides with the rotational axis of the toner supply roller 13.

<Comparative Developing Apparatus 3>

The third comparative developing apparatus is the same in structure as the second comparative developing apparatus. However, in the case of this comparative developing apparatus, the "toner supply bias" is not applied.

<Comparative Developing Apparatus 4>

Figure 10:
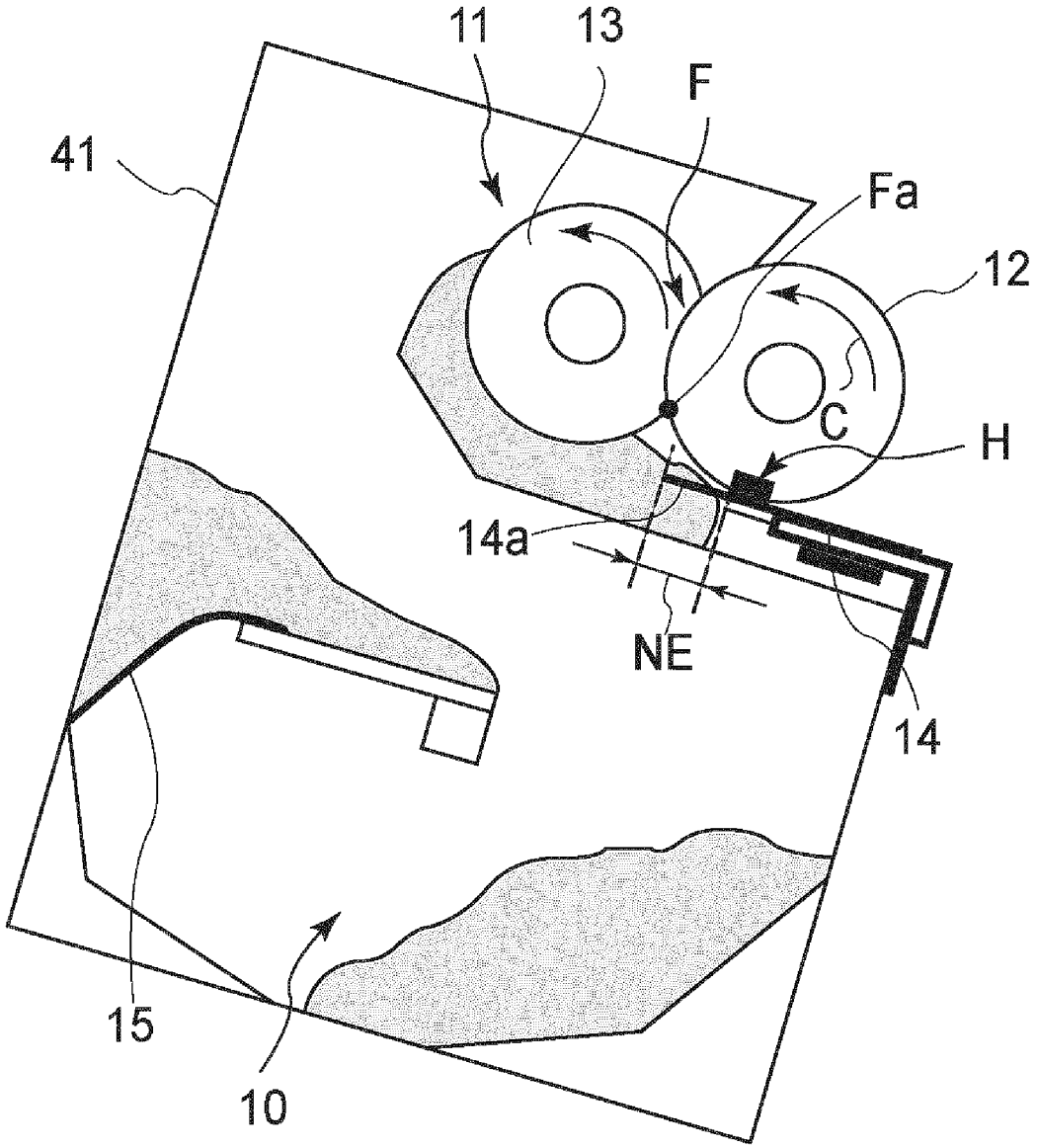
FIG. 10 is a schematic sectional view of the fourth comparative developing apparatus, showing the general structure of the apparatus.
Figure 11:
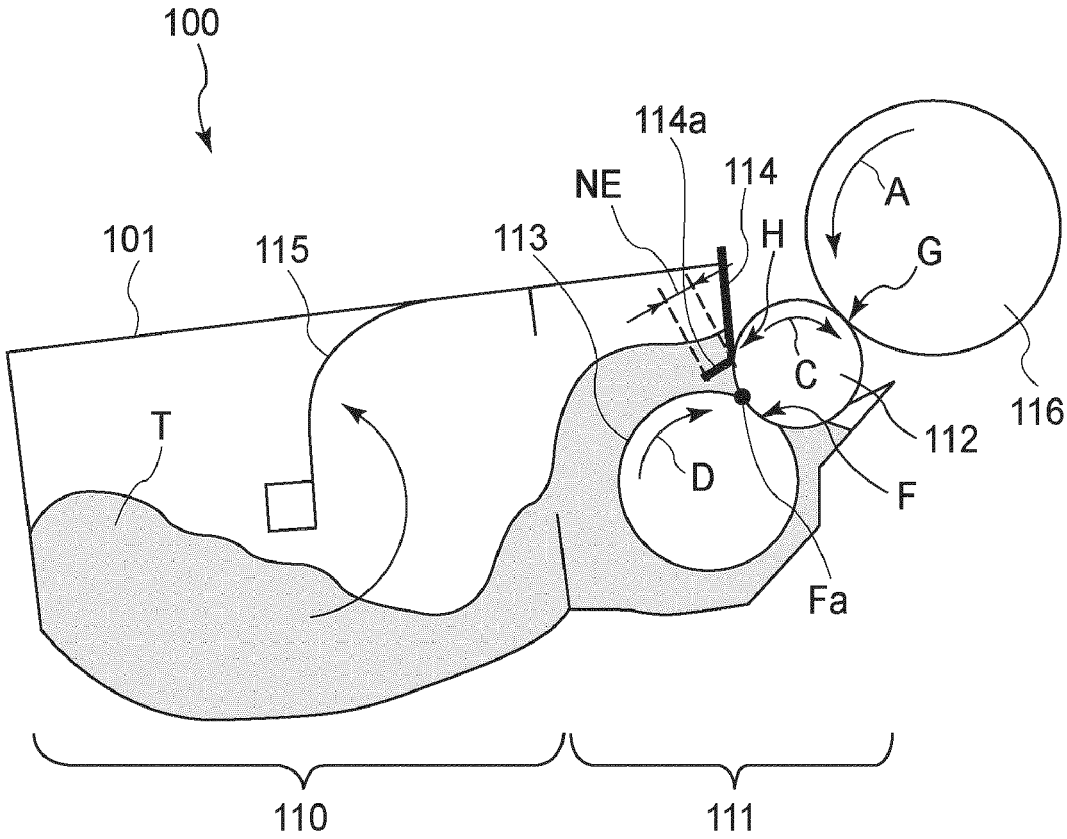
FIG. 11 is a schematic sectional view of a conventional developing apparatus, which uses nonmagnetic single-component developer.

Referring to FIG. 10, in terms of the positioning of the development roller 12 and toner supply roller 13, the fourth comparative developing apparatus is the same as the developing apparatus 4 in this embodiment. However, in the case of the fourth comparative developing apparatus, the blade 14 extends beyond the area of contact H between the blade 14 and development roller 12; in terms of the direction in which the blade 14 extends, the edge portion 14*a* of the blade 14 is beyond the area of contact H between the blade 14 and development roller 12. Unlike the abovementioned one of the features of the developing apparatus 4 in the first embodiment of the present invention, which characterizes the present invention, it is not by the edge 14*a* that the blade 14 of the fourth comparative developing apparatus is not placed in contact with the development roller 12. That is, the blade 14 extends beyond the point of contact between the blade 14 and development roller 12; the portion (NE) of the blade 14, which is between the edge 14*a* of the blade 14 and the area of contact H between the blade 14 and development roller 12, extends into the development chamber 11. Thus, the portion of the blade 14, which is near the edge 14*a* of the blade 14, is not in contact with the development roller 12.

Next, the results of the abovementioned comparative studies will be described. The results of the comparative studies are summarized in Table 1.

All of the four comparative developing apparatuses are lower in the amount of the electrical charge of the toner on the peripheral surface of the development roller 12, and also, are worse in terms of fog, than the developing apparatus 4 in this embodiment, regardless of the difference in structure.

Based on the results of comparison between the structure of the developing apparatus 4 in this embodiment, and that of the first comparative developing apparatus, the following may be inferred: Not only did the application of the toner supply bias ensure that only the toner particles which are normal in the polarity of their electrical charge are supplied to the development roller 12, but also, increased the amount by which the toner particles are electrically charged. Therefore, the developing apparatus 4 in this embodiment was better in terms of fog than the comparative developing apparatuses.

The effectiveness of the toner supply bias is evident from the results of comparison between the developing apparatus 4 in this embodiment, and the second and third comparative developing apparatuses. Incidentally, in terms of the amount of electrical charge of toner and the severity of fog, the second comparative developing apparatus is not much different from the third comparative developing apparatus.

Figure 9:
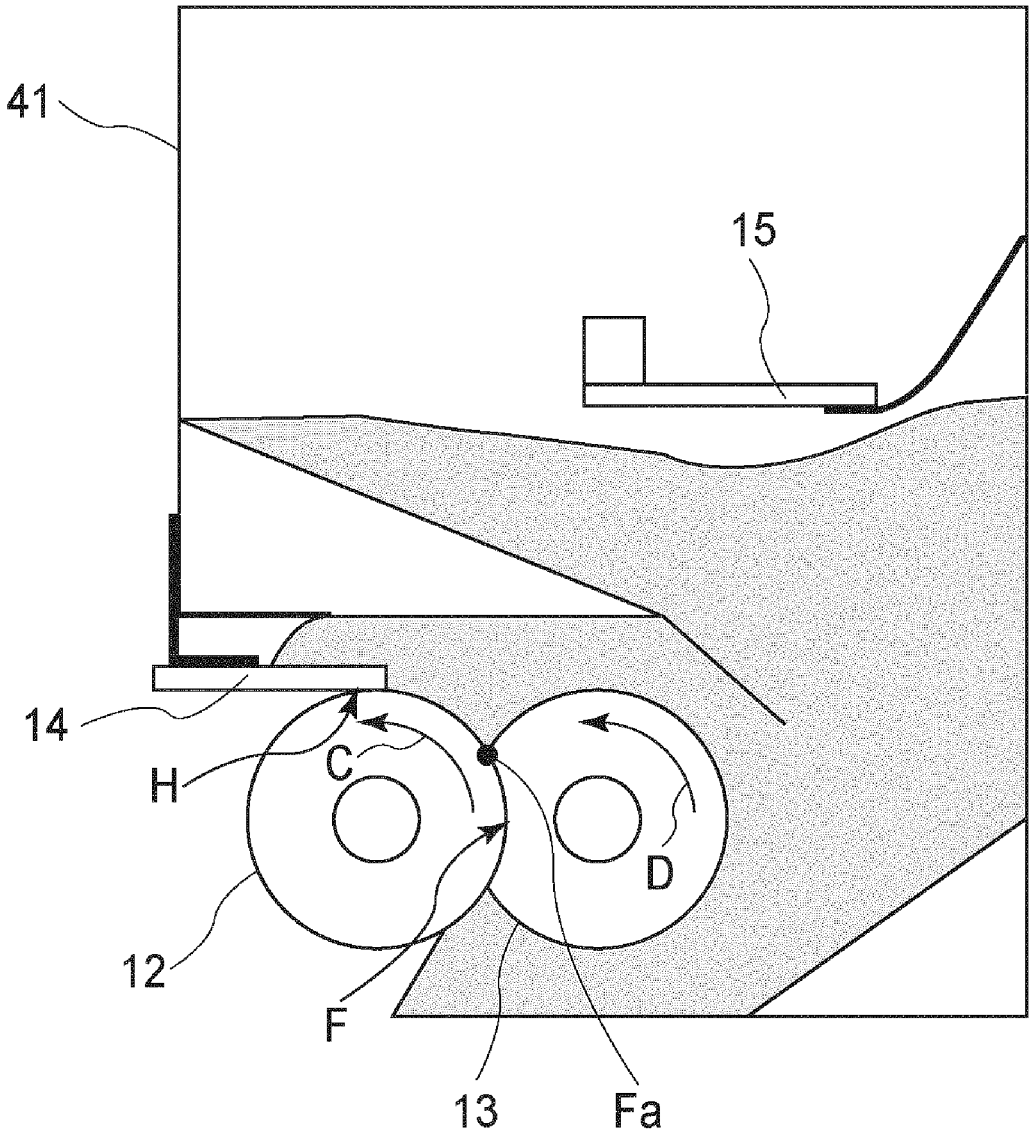
FIG. 9 is a schematic sectional view of the second and third comparative developing apparatuses, showing the general structure of the apparatuses.

In the case of the second comparative developing apparatus structured as shown in FIG. 9, the toner spewing portion Fa is on the top side of the area of contact between the toner supply roller 13 and development roller 12, allowing thereby the spewed toner to hang over the peripheral surface of the development roller 12 and settle on the peripheral surface of the development roller 12. Thus, these tone particles, that is, the toner particles which have not been electrically charged, are sent into the regulating portion H by the rotation of the development roller 12, and some of them remain coated on the peripheral surface of the development roller 12. Thus, even if the toner supply bias is applied to ensure that only the toner particles which are normal in polarity and amount of electrical charge are supplied to the development roller 12, the toner supply bias has little effect upon the amount of the electrical charge which the toner particles on the development roller 12 have on the downstream side of the area of contact H, in terms of the rotational direction of the development roller 12.

Further, it became evident from the comparison between the structure of the developing apparatus 4 in this embodiment and that of the fourth comparative developing apparatus that the state of contact between the blade 14 and development roller 12 also has a large amount of effect upon the amount of fog and the amount of electrical charge of toner on the development roller 12, on the downstream side of the area of contact H.

In the case of the structure of the developing apparatus 4 in this embodiment, the blade 14 is in contact with the peripheral surface of the development roller 12 by its edge 14*a*. However, in the case of the structure of the fourth comparative developing apparatus, the blade 14 is in contact with the peripheral surface of the development roller 12 by its belly portion, and therefore, the portion NE of the blade 14, which extends beyond the area of contact H between the blade 14 and development roller 12, guides toner into the regulating portion H.

In the case of the fourth comparative developing apparatus, the toner particles spewed from the toner spewing portion Fa are floating in the adjacencies of the blade 14. These toner particles are those which were not supplied to the development roller 12, and are unsatisfactory in the amount of electrical charge, and also, are reverse in polarity. These toner particles reach the adjacencies of the blade 14 by riding the wind (air flow) generated by the rotation of the development roller 12. In addition, the portion NE of the blade 14 guides these toner particles into the regulating portion H, in which they are coated on the peripheral surface of the development roller 12. Therefore, the effects of the toner supply bias are nullified. This is thought to be why the fourth comparative developing apparatus is smaller in the amount of toner charge, on the downstream side of the regulating portion H, and inferior in terms of fog than the developing apparatus 4 in this embodiment.

The inventors of the present invention presumed that as long as the amount of fog of an image is no more than 1.5%, the fog dose not create any problem in terms of image quality, whereas if the amount of fog of an image is no less than 2.0%, the fog is conspicuous, and therefore, the image falls outside the tolerable range in terms of quality. In other words, in order for an image to be thought to be high in quality, the amount of its fog is desired to no more than 1.5%.

TABLE 1

| | Spewing portion | Supply bias | Blade contact | Q/M (μC/g) | Fog (%) |
|---|---|---|---|---|---|
| Embodiment | Dwn | Y | Edge | 40 | 1.4 |
| Comp. Ex. 1 | Dwn | N | Edge | 33 | 2.5 |
| Comp. Ex. 2 | Up | Y | Edge | 36 | 2.0 |
| Comp. Ex. 3 | Up | N | Edge | 34 | 2.4 |
| Comp. Ex. 4 | Dwn | Y | NE | 31 | 2.8 |

The comparative studies described above revealed the following:

In order for the structure of a developing apparatus to concur with the structural features of the developing apparatus 4 in this embodiment, which characterizes the present invention, it is important that the developing apparatus is structured so that the toner supply bias is applied; the toner supply roller 13 and development roller 12 are positioned so that while a given portion of the peripheral surface of the development roller 12 moves through the range between the coating portion F and regulating portion H, it faces downward; and the blade 14 contacts the peripheral surface of the development roller 12 by its edge. This structural arrangement stabilizes a developing apparatus in terms of the amount of the electrical charge of the toner on the development roller 12, on the downstream side of the area of contact between the blade 14 and development roller 12 in terms of the rotational direction of the development roller 12, and also, is effective to prevent the formation of an image suffering from fog. As described above, the developing apparatus 4 in this embodiment is structured so that the toner spewing portion Fa is level with, or below, the horizontal plane H13 which coincides with the rotational axis O13 (FIG. 5) of the toner supply roller 13. Therefore, it does not occur that the toner particles in the adjacencies of the downstream (upstream) edge of the area of contact between the toner supply roller 13 and development roller 12, in terms of the rotational direction of the development roller 12 (toner supply roller 13), continuously recirculates in the abovementioned adjacencies. Therefore, it does not occur that toner abnormally deteriorates in the adjacencies of the downstream edge of the area of contact between the toner supply roller 13 and development roller 12. Therefore, the above described effects of the structural arrangement for a developing apparatus lasts for a long period of time.

As described above, the developing apparatus 4 in this embodiment is structured so that:

(1) voltage which is the same in polarity as the toner, and is different in potential level from the voltage applied to the development roller 12, is applied to the toner supply roller 13, so that difference in potential level is provided between the toner supply roller 13 and development roller 12;

(2) the development roller 12 and toner supply roller 13 are positioned so that while a given portion of the peripheral surface of the development roller 12 is moved by the rotation of the development roller 12 through the range between the downstream edge Fa of the area of contact between the development roller 12 and toner supply roller 13, in terms of the rotational direction of the development roller 12 and the area of contact H (regulating portion) between the development roller 12 and regulating blade 14, it faces downward;

(3) the regulating blade 14 is in contact with the peripheral surface of the development roller 12 by its edge 14*a*, and the downstream edge Fa of the area of contact F between the development roller 12 and toner supply roller 13, in terms of the rotational direction of the development roller 12, is level with, or lower than the horizontal plane H13 which coincides with the rotational axis O13 of the toner supply roller 13.

With the developing apparatus 4 structured as described above, only the toner particles which are satisfactory in terms of the amount of electrical charge are supplied to the development roller 12. Therefore, only the toner particles which are normal in polarity and satisfactory in the amount of electrical charge are coated on the development roller 12, and therefore, the developing apparatus 4 is stable in the amount of the electrical charge of the toner on the development roller 12, on the downstream side of the regulating portion H. Further, these effects of the structural arrangement for a developing apparatus last for a long period of time. Thus, the developing apparatus 4 in this embodiment can prevent the problems, such as the formation of an image which is suffering from fog, and/or abnormal in density, which occurs when a developing apparatus is unstable in the amount of the electrical charge of the toner on its development roller.

In this embodiment, the difference in potential level between the toner supply roller 13 and development roller 12 was set to 200 V. However, it does not need to be set to this value. That is, it may be varied according to the electrical resistances of the components of the developing apparatus (developing apparatus 4, in particular), and the characteristics of the toner used by the developing apparatus 4.

Also in this embodiment, a piece of SUS plate was used as the blade 14. However, the material for the blade 14 does not need to be limited to SUS plate. For example, it may be a piece of metallic plate coated with resin. Further, regarding the voltage to be applied to the blade 14, in this embodiment, such voltage that provides 200 V of difference in potential level between the blade 14 and development roller 12 was applied to the blade 14. This setup, however, may be modified.

Further, this embodiment was described with reference to the developing apparatus 4 (developing means), which is an integral part of the process cartridge 8 which is removably mountable in the main assembly 200A of the image forming apparatus 200. However, the present invention is also compatible with a developing apparatus that is an integral part of a process cartridge, which is removably mountable in the main assembly 200A of the image forming apparatus 200, but, does not have a photosensitive member. It is also compatible with a developing apparatus that is an integral portion of the main assembly 200A of the image forming apparatus 200.

Further, in the embodiment described above, the image forming apparatus was a color image forming apparatus. However, the application of the present invention is not limited to a color image forming apparatus. For example, the present invention is applicable to a monochromatic image forming apparatus as well.

Further, this embodiment was described with reference to the color image forming apparatus which employs the intermediary transfer medium, that is, the intermediary transfer belt 20. However, the present invention is also applicable to a color image forming apparatus structured so that a color image is effected by directly transferring in sequence the toner images formed on the multiple photosensitive drums 1 in the image forming portions P (PY, PM, PC, and PK), one for one, onto the recording medium S, instead of the intermediary transfer belt 20, while the recording medium S is conveyed through the image forming portions P, one after another, by the recording medium conveying belt. An image forming apparatus, such as the above described one, that is, the so-called image forming apparatus of the direct transfer type, which directly transfer an image from a photosensitive member to the transfer medium S, is well-known to the people in this business, and therefore, will not be described in detail here.

According to the present invention, a developing apparatus is structured so that only the developer particles which are normal in polarity and amount of electrical charge, are supplied to the developer bearing member, in order to prevent the formation of images suffering from such an image defects as fog, which occurs when the developing apparatus becomes unstable in the amount of the electrical charge of the developer on the developer bearing member. Therefore, an image forming apparatus in accordance with the present invention can continuously form satisfactory images for a long period of time.

While the invention has been described with reference to the structures disclosed herein, it is not confined to the details set forth, and this application is intended to cover such modifications or changes as may come within the purposes of the improvements or the scope of the following claims.

This application claims priority from Japanese Patent Application No. 029719/2007 filed Feb. 8, 2007, which is hereby incorporated by reference.

What is claimed is:

1. A developing apparatus comprising:

(a) a development chamber, including:

(a-1) a developer carrying member for carrying a developer to develop an electrostatic image formed on an image bearing member with a developer;

(a-2) a developer feeding member, contactable to said developer carrying member, for supplying the developer to said developer carrying member at a first contact portion where said developer carrying member contacts said developer feeding member, said developer feeding member rotates substantially upwardly in a direction of peripheral movement opposite a peripheral movement of said developer carrying member at the first contact portion; and (a-3) a regulating member for regulating an amount of the developer carried on said developer carrying member, said regulating member having a free end portion contacted to said developer carrying member and only an edge of said regulating member contacting a peripheral surface of said developer carrying member, wherein said developer feeding member is supplied with a voltage such that the voltage minus a potential of said developer carrying member has a polarity which is the same as a regular charging polarity of the developer, and wherein said developer carrying member is provided with a surface facing substantially downward, in a range from a downstream-most edge of the first contact portion of said developer carrying member with respect to a rotational direction of said developer carrying member to a second contact portion between said developer carrying member and said regulating member; and (b) a developer storage container, provided below said development chamber, for storing the developer, including:

(b-1) a developer conveying member for conveying the developer contained in said developer storage container to said development chamber, wherein said development chamber has a storage portion which intersects a vertical line passing through the downstream-most edge and which stores the developer conveyed by said developer conveying member.

2. A developing apparatus according to claim 1, wherein the downstream-most edge of said developer carrying member is level with, or is lower than, a horizontal plane passing through a rotation axis of said developer feeding member.

3. A developing apparatus according to claim 1, wherein the developer is a non-magnetic one component developer.

4. A developing apparatus according to claim 1, wherein said developing apparatus is provided in a cartridge detachably mountable to a main assembly of an image forming apparatus.

5. A developing apparatus according to claim 1, wherein said developing apparatus is provided in a cartridge detachably mountable to a main assembly of an image forming apparatus, together with the image bearing member.

6. A developing apparatus according to claim 1, wherein said developing apparatus is provided in an image forming apparatus together with the image bearing member.

7. A developing apparatus according to claim 1, wherein said regulating member does not intersect the vertical line passing through the downstream-most edge.

8. A developing apparatus according to claim 1, wherein said developer carrying member, said developer feeding member and said regulating member are enclosed in said development chamber.

9. A developing apparatus according to claim 1, wherein said developer conveying member is rotatable about an axis which is below said storage portion.

* * * * *